US010139752B2

(12) United States Patent
Murata et al.

(10) Patent No.: US 10,139,752 B2
(45) Date of Patent: Nov. 27, 2018

(54) IMAGE FORMING APPARATUS, TONER CASE ATTACHABLE TO IMAGE FORMING APPARATUS

(71) Applicant: KYOCERA Document Solutions Inc., Osaka-shi, Osaka (JP)

(72) Inventors: Koji Murata, Osaka (JP); Yoshitaka Tokoro, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/961,628

(22) Filed: Apr. 24, 2018

(65) Prior Publication Data

US 2018/0307157 A1 Oct. 25, 2018

(30) Foreign Application Priority Data

Apr. 25, 2017 (JP) ..... 2017-085948

(51) Int. Cl.
*G03G 15/08* (2006.01)

(52) U.S. Cl.
CPC . *G03G 15/0865* (2013.01); *G03G 2215/0692* (2013.01)

(58) Field of Classification Search
CPC ..... G03G 15/0865; G03G 2215/0692
See application file for complete search history.

(56) References Cited

U.S. PATENT DOCUMENTS

2012/0106985 A1* 5/2012 Tanaka ..... G03G 15/0863 399/12
2012/0114386 A1* 5/2012 Takashima ..... G03G 15/0879 399/258
2017/0219986 A1* 8/2017 Murata ..... G03G 15/80
2018/0173156 A1* 6/2018 Murata ..... G03G 15/0867

FOREIGN PATENT DOCUMENTS

JP 2010032594 A 2/2010

* cited by examiner

*Primary Examiner* — G. M. A Hyder
(74) *Attorney, Agent, or Firm* — Alleman Hall Creasman & Tuttle LLP

(57) ABSTRACT

A shutter member of a toner case includes a compatible key and an engaged portion. A storage portion for storing the toner case includes a compatible member rockably supported at a position that faces the shutter member during an insertion process of the toner case. The compatible member includes a first contact portion and a first engaging portion. The first contact portion is located on a forward side of a rocking shaft of the compatible member in the insertion direction. The first engaging portion is located on a backward side of the rocking shaft in the insertion direction. During an insertion process of the toner case, the first engaging portion of the compatible member is engaged with the engaged portion so that the shutter member moves from a closing position to an opening position.

6 Claims, 14 Drawing Sheets

IMAGE FORMING APPARATUS, TONER CASE ATTACHABLE TO IMAGE FORMING APPARATUS

INCORPORATION BY REFERENCE

This application is based upon and claims the benefit of priority from the corresponding Japanese Patent Application No. 2017-085948 filed on Apr. 25, 2017, the entire contents of which are incorporated herein by reference.

BACKGROUND

The present disclosure relates to an image forming apparatus including a case attachment portion configured to support, in a detachable manner, a toner case that has an attachment compatibility with the case attachment portion, and relates to a toner case attachable to an image forming apparatus.

An image forming apparatus of an electrophotographic system includes a developing device. Developer including toner is stored in the developing device. The developing device develops an electrostatic latent image formed on an image carrier such as a photoconductor drum, with the toner included in the developer. As developing is performed, the toner stored in an interior of the developing device is reduced. The image forming apparatus includes a case attachment portion to which the toner case is attached, and is configured in such a manner that the toner case is attached to the case attachment portion. The toner case includes a toner discharge port for discharging the toner and a shutter member for opening and closing the toner discharge port. When the toner case is attached to the case attachment portion, the shutter member moves to an opening position so as to open the toner discharge port. This allows the toner to be replenished from the toner case to the developing device. In addition, the toner case is configured to be attached to the case attachment portion of the image forming apparatus in a detachable manner. When all toner in the toner case is consumed, the toner case is replaced with a new toner case filled with toner.

Meanwhile, there is known an image forming apparatus provided with an incompatibility structure in which only a toner case having attachment compatibility can be attached to the case attachment portion, so as to prevent replenishment of improper toner to the developing device by an erroneous attachment. In this type of image forming apparatus, the toner case is provided with a claw member which functions as a compatible key that permits attachment of the toner case only to a case attachment portion that corresponds to the toner case. In addition, the case attachment portion is provided with a claw passage portion and an interference member, wherein the claw passage portion functions as a compatible key that permits attachment of only a corresponding toner case, and the interference member functions as an incompatible key that does not permit attachment of a toner case that does not correspond to the case attachment portion.

SUMMARY

An image forming apparatus according to an aspect of the present disclosure includes a toner case and a case attachment portion. The toner case includes a shutter member configured to move between an opening position and a closing position, wherein when the shutter member is at the opening position, a toner discharge port formed in a bottom portion of the toner case is opened, and when the shutter member is at the closing position, the toner discharge port is closed. The case attachment portion supports the toner case inserted in it toward a predetermined attachment position such that the toner case is attached at the attachment position in a detachable manner. The shutter member includes: a compatible key projecting downward from the shutter member and provided at a compatible position that corresponds to a type of the toner case; and an engaged portion provided at a position separated from the compatible key in a direction opposite to an insertion direction in which the toner case is inserted in the case attachment portion. The case attachment portion includes: a compatible member rockably supported at a position that faces the shutter member during a process in which the toner case is inserted in the case attachment portion, the compatible member including a first contact portion and a first engaging portion, the first contact portion being located on a forward side of a rocking fulcrum in the insertion direction, the first engaging portion being located on a backward side of the rocking fulcrum in the insertion direction. In a state where the toner case is not inserted in the case attachment portion, the compatible member is disposed at a first position where the first engaging portion is separated from an insertion path of the compatible key, and the first contact portion intersects the insertion path, and during the process in which the toner case is inserted in the case attachment portion, the compatible member is disposed at a second position where the compatible key comes in contact with the first contact portion and causes the compatible member to rock so that the first contact portion is separated from the insertion path and the first engaging portion is engaged with the engaged portion, and the shutter member moves from the closing position to the opening position.

A toner case according to another aspect of the present disclosure includes a shutter member which moves between an opening position and a closing position, wherein when the shutter member is at the opening position, a toner discharge port formed in a bottom portion of the toner case is opened, and when the shutter member is at the closing position, the toner discharge port is closed, the toner case being attachable at a predetermined attachment position in a case attachment portion. The shutter member includes: a compatible key projecting downward from the shutter member and provided at a compatible position that corresponds to a type of the toner case; and an engaged portion provided at a position separated from the compatible key in a direction opposite to an insertion direction in which the toner case is inserted in the case attachment portion. During a process in which the toner case is inserted toward the attachment position, a compatible member provided in the case attachment portion is separated from an insertion path of the compatible key, and a part of the compatible member is engaged with the engaged portion in response to separation of the compatible member from the insertion path such that the shutter member moves from the closing position to the opening position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

Figure 1:
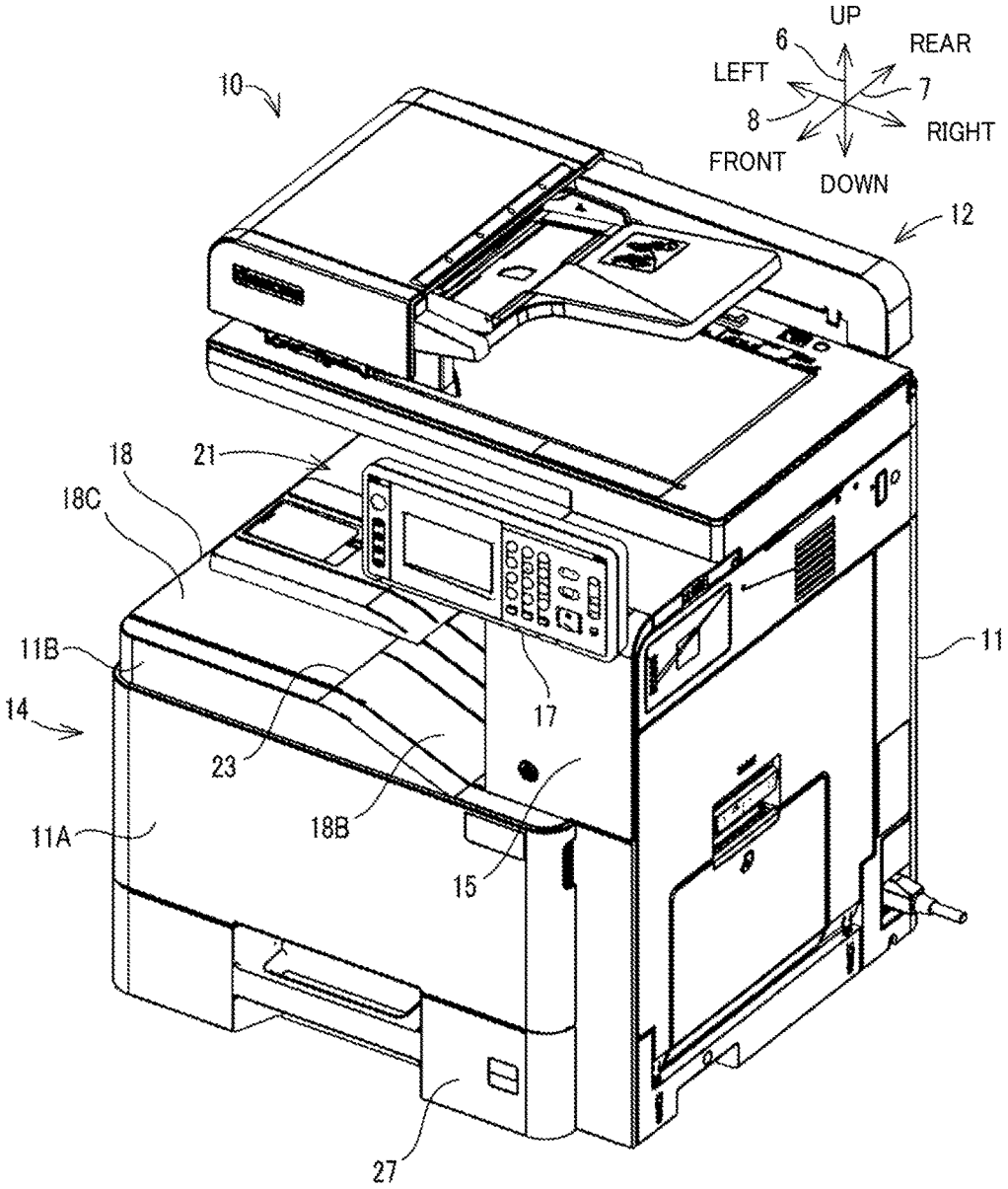
FIG. 1 is a perspective diagram showing an image forming apparatus according to an embodiment of the present disclosure.

FIG. 1 shows a configuration of an image forming apparatus 10 according to an embodiment of the present disclosure. It is noted that for the sake of explanation, a vertical direction in a state where the image forming apparatus 10 is installed in a usable manner (the state shown in FIG. 1) is defined as an up-down direction 6. In addition, a front-rear direction 7 is defined on the basis that a side on which an operation/display portion 17 is provided in the installed state is the front (front side). Furthermore, a left-right direction 8 is defined on the basis of the front side of the image forming apparatus 10 in the installed state.

As shown in FIG. 1, the image forming apparatus 10 is a multifunction peripheral having a plurality of functions such as a print function, a copy function, a facsimile function, and a scan function. The image forming apparatus 10 is not limited to a multifunction peripheral, but may be a printer having the print function, a fax device or the like.

The image forming apparatus 10 includes an image reading portion 12 and an image forming portion 14. The image reading portion 12 performs a process of reading an image from a document sheet, and is provided in an upper portion of the image forming apparatus 10. The image forming portion 14 performs a process of forming a color image based on an electrophotographic system, and is provided in a lower portion of the image forming apparatus 10. In addition, on the right side of the image forming portion 14, a sheet discharge portion 15 is provided.

A discharge space 21 is provided above the image forming portion 14. The sheet discharge portion 15 couples the image forming portion 14 with the image reading portion 12 in the vertical direction, while forming the discharge space 21 between the image forming portion 14 and the image reading portion 12. As shown in FIG. 1, the front side and the left side of the sheet discharge space 21 are opened. In addition, the rear side of the sheet discharge space 21 is not opened, but is closed by a rear panel or the like. In addition, on the right side of the discharge space 21, the sheet discharge portion 15 is provided.

The sheet discharge portion 15 discharges a sheet member with an image formed thereon to the discharge space 21. On the left side surface of the sheet discharge portion 15 that faces the discharge space 21, a sheet discharge port 15A (see FIG. 2) is formed. The sheet discharge port 15A is formed to be higher in position than a sheet tray 18 that is described below. The sheet member is discharged from the sheet discharge port 15A.

The image forming portion 14 includes a housing 11 as an appratus main body. The components constituting the image forming portion 14 are arranged in the housing 11. The housing 11 includes an exterior frame and an internal frame, wherein the exterior frame covers the whole of the image forming portion 14, and the internal frame supports the components constituting the image forming portion 14. The housing 11, as a whole, has an approximately rectangular parallelepiped shape.

The housing 11 includes a front cover 11A and a side cover 11B that is provided above the front cover 11A. The front cover 11A and the side cover 11B cover a front opening (not shown) that is formed on the front side of the housing 11.

Figure 2:
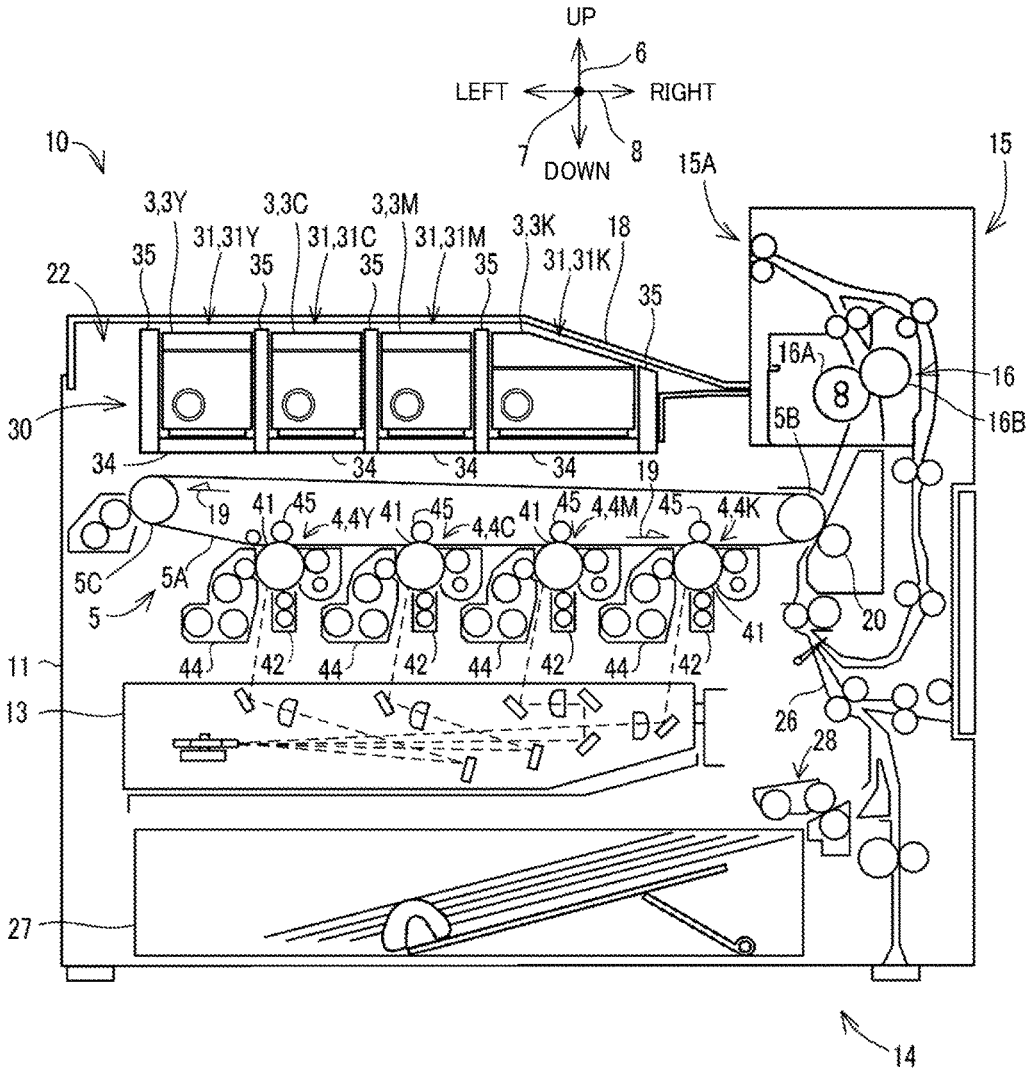
FIG. 2 is a diagram showing an internal configuration of an image forming portion included in the image forming apparatus.

FIG. 2 is a diagram showing an internal configuration of the image forming portion 14. In FIG. 2, the image reading portion 12 is omitted. The image forming portion 14 forms, by a so-called tandem system, a color image on a sheet member such as a print sheet. As shown in FIG. 2, the image forming portion 14 includes four image forming units 4, an intermediate transfer unit 5, a laser scanning unit 13, a secondary transfer roller 20, a fixing device 16, a sheet tray 18, a sheet cassette 27, a sheet feed unit 28, the operation/display portion 17 (see FIG. 1), a conveyance path 26, a container attachment portion 30, four toner containers 3 (an example of the toner case of the present disclosure), and a control portion (not shown).

The image forming units 4 (4Y, 4C, 4M and 4K) are provided below the intermediate transfer unit 5. The four image forming units 4 are arranged in alignment along the running direction (the direction indicated by the arrow 19) of a transfer belt 5A. In order from left to right of the transfer belt 5A, the image forming units 4Y for yellow color, 4C for cyan color, 4M for magenta color, and 4K for black color are disposed in the stated order. Each of the image forming units 4 includes a photoconductor drum 41, a charging device 42, a developing device 44, and a primary transfer roller 45. The image forming unit 4Y forms a toner image on the surface of the photoconductor drum 41 by using yellow toner. The image forming units 4C, 4M and 4K form toner images on the surfaces of the photoconductor drums 41 by using cyan toner, magenta toner, and black toner, respectively. The developing devices 44 respectively perform developing processes of developing the toner images on the photoconductor drums 41.

As shown in FIG. 2, the intermediate transfer unit 5 includes a transfer belt 5A, a driving roller 5B and a driven roller 5C. The transfer belt 5A is a belt member on which toner images of respective colors are transferred from the photoconductor drums 41 of the image forming units 4. The transfer belt 5A is disposed above the photoconductor drums 41. The transfer belt 5A is supported by the driving roller 5B and the driven roller 5C so as to move around them, wherein the driving roller 5B and the driven roller 5C are separated from each other in the left-right direction 8. The transfer belt 5A is suspended between the driving roller 5B and the driven roller 5C. When the transfer belt 5A passes through between the photoconductor drums 41 and the primary transfer rollers 45, the toner images are transferred in sequence from the photoconductor drums 41 onto a surface of the transfer belt 5A so as to be overlaid with each other.

The sheet member with the toner image transferred thereon by the secondary transfer roller 20 is conveyed to the fixing device 16. The fixing device 16 fixes the toner image transferred on the sheet member, to the sheet member by heating it. The fixing device 16 includes a heating roller 16A and a pressure roller 16B. The toner image transferred to the sheet member is heated by the heating roller 16A when the sheet member passes through the fixing device 16. This allows the toner image to be fixed to the sheet member. Subsequently, the sheet member is discharged to the sheet tray 18 by the sheet discharge portion 15.

As shown in FIG. 2, the sheet tray 18 is provided in the discharge space 21. The sheet tray 18 also serves as an exterior frame that constitutes an upper surface of the image forming portion 14. As shown in FIG. 1 and FIG. 2, the sheet tray 18 has an inclined surface that extends diagonally upward from its end on the sheet discharge port 15A side, toward the left side. The sheet tray 18 holds sheet members that have passed through the fixing device 16 and have been discharged to outside from the sheet discharge port 15A of the sheet discharge portion 15. The sheet members discharged to the sheet tray 18 are stacked thereon.

As shown in FIG. 2, a storage space 22 is formed between the intermediate transfer unit 5 and the sheet tray 18. The container attachment portion 30 is provided in the storage space 22. That is, the sheet tray 18 is provided above the container attachment portion 30, and the intermediate transfer unit 5 is provided below the container attachment portion 30.

The container attachment portion 30 is fixed to the internal frame of the housing 11. The container attachment portion 30 holds the four toner containers 3 (3Y, 3C, 3M and 3K) in a detachable manner. That is, the toner containers 3 are attached to the container attachment portion 30 of the image forming apparatus 10 in a detachable manner. It is noted that the four toner containers 3 store the toner as follows: the toner container 3Y stores yellow toner, the toner container 3C stores cyan toner, the toner container 3M stores magenta toner, and the toner container 3K stores black toner.

The container attachment portion 30 includes four storage portions 31 (an example of the case attachment portion of the present disclosure) which respectively store the toner containers 3 of different colors and in which the toner containers 3 are attached at predetermined attachment positions. The container attachment portion 30 supports the toner containers 3 in the storage portions 31 (31Y, 31C, 31M and 31K) in such a manner that the toner containers 3 can slide in the front-rear direction 7. Each of the storage portions 31 has an opening on the front side, and supports a toner container 3 inserted therein from the opening toward the rearside, in such a manner that the toner container 3 can slide in the front-rear direction 7. The four storage portions 31 respectively correspond to the toner containers 3 of different colors, and are arranged in alignment along the left-right direction 8. The storage portions 31 are sectioned from each other by five partition walls 35 that are arranged in alignment in the left-right direction 8, and by four support frames 34 respectively provided in the storage portions 31, and the toner containers 3 are slidably supported by the support frames 34.

In the present embodiment, a storage portion 31K that is located on the most right side in the container attachment portion 30, is different in shape from the other storage portions 31Y, 31C and 31M. The rightmost storage portion 31K stores black toner. Since the toner container 3K stores black toner that is consumed most, the toner container 3K is larger in capacity than the other toner containers 3 (3Y, 3C and 3M). The storage portion 31K for black is formed to match the shape of the toner container 3K, and thus is different in shape from the other storage portions 31Y, 31C and 31M. It is noted that the toner containers 3Y, 3C and 3M and the storage portions 31Y, 31C and 31M for storing corresponding toner containers 3Y, 3C and 3M, have approximately the same shape, respectively. It is noted that, as described below, each corresponding pair of a toner container 3 and a storage portions 31 has a different structure (incompatibility structure) such that a toner container 3 can only be attached to a storage portions 31 that has attachment compatibility therewith.

Meanwhile, according to a conventional incompatibility structure, in a case where a claw member provided on a toner case is lost due to breakage or the like, and the toner case is inserted in a case attachment portion that does not correspond to the toner case, an interference member provided on the case attachment portion may not be able to interfere with the toner case, but may permit an attachment of the toner case to the not-corresponding case attachment portion. If a toner case that stores toner of a color that does not correspond to a case attachment portion, is attached to the case attachment portion, a shutter member is opened, and inappropriate toner is replenished to a developing device. This is not preferable since it may generate a problem such as a print failure. On the other hand, according to the image forming apparatus 10 of the present embodiment, the toner containers 3 have attachment compatibility with corresponding storage portions 31, and even if a toner container 3 that does not have attachment compatibility with a storage portion 31 is inserted in the storage portion 31, the shutter member stays at the closing position.

The following describes in detail configurations of the toner container 3Y and the storage portion 31Y for storing the toner container 3Y.

Figure 3:
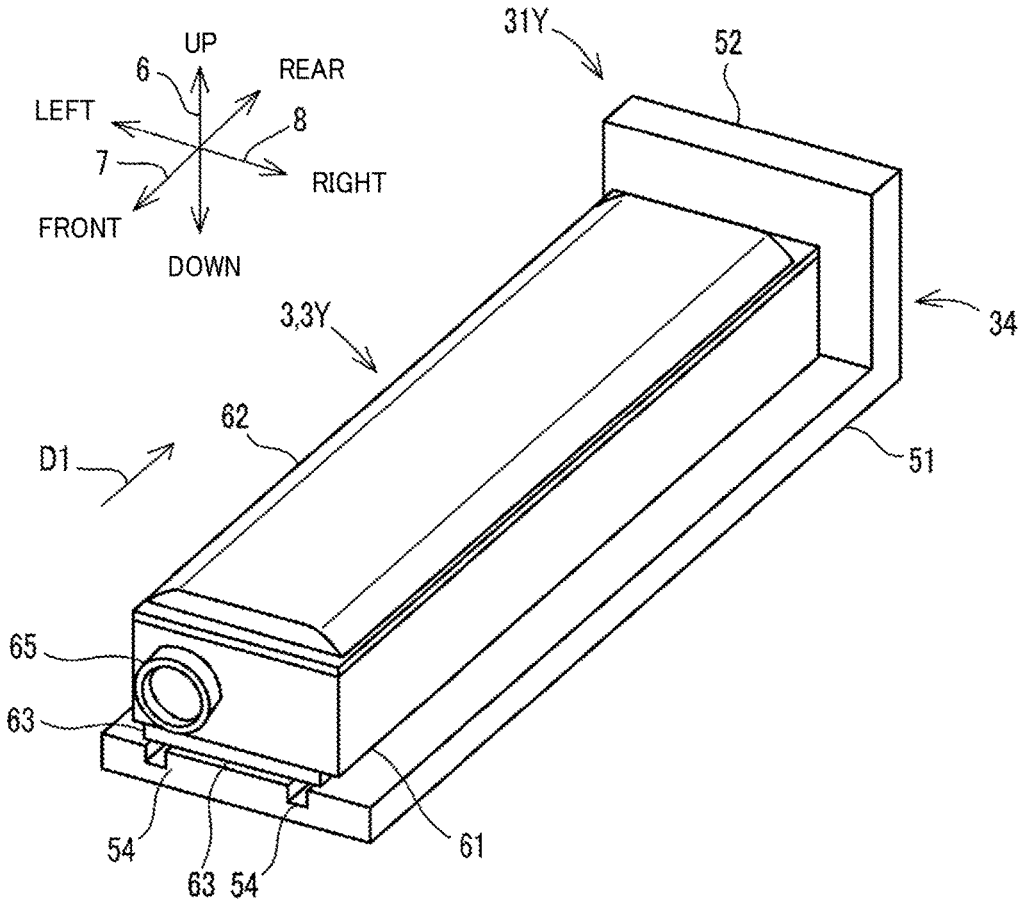
FIG. 3 is a perspective diagram showing a state where a toner container is supported by a support frame of a storage portion for yellow.
Figure 4:
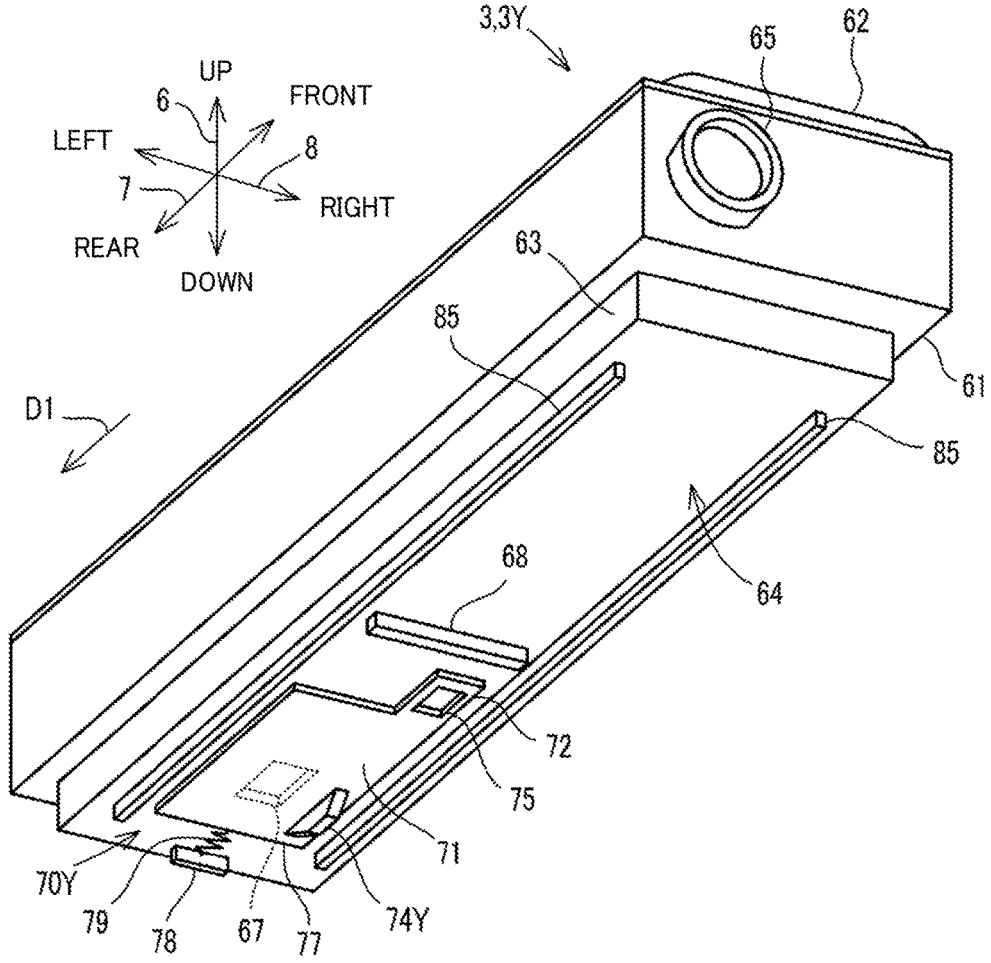
FIG. 4 is a perspective diagram of a toner container for yellow.
Figure 5:
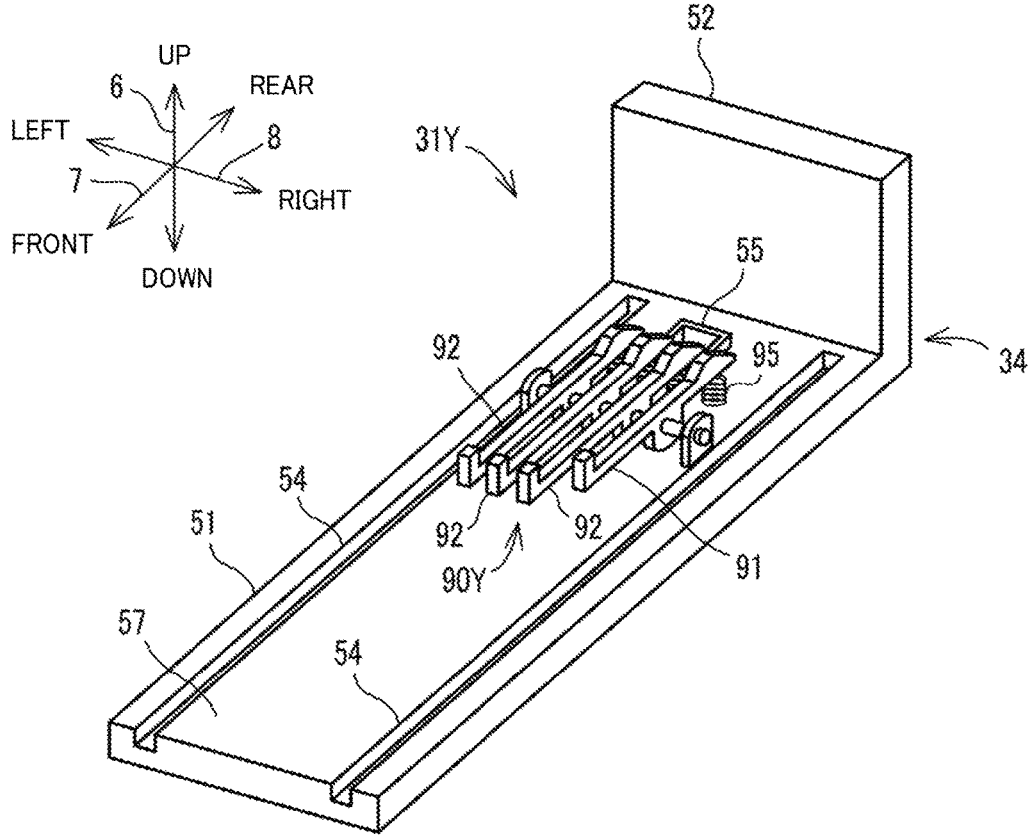
FIG. 5 is a perspective diagram of a support frame for yellow.
Figure 6:
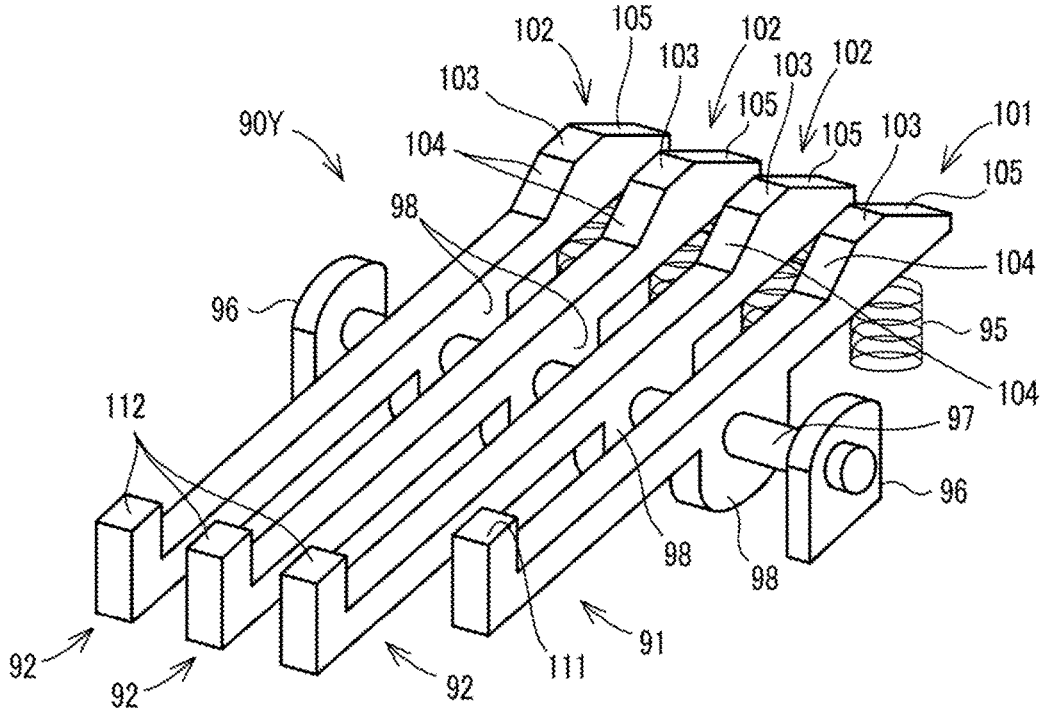
FIG. 6 is a perspective diagram showing an incompatibility mechanism provided in the support frame for yellow.

FIG. 3 is a perspective diagram showing a state where the toner container 3Y is supported on the support frame 34 of the storage portion 31Y for yellow. FIG. 4 is a perspective diagram of the toner container 3Y. FIG. 5 is a perspective diagram of the support frame 34 for yellow. In addition, FIG. 6 is a perspective diagram showing an incompatibility mechanism 90Y provided on the support frame 34. Here, in each drawing, the vertical direction is defined as the up-down direction 6, an insertion/removing direction of the toner container 3Y with respect to the housing 11 is defined as the front-rear direction 7, and a horizontal direction when viewed from the front is defined as the left-right direction 8, on the basis of the attitudes of the toner container 3Y and the support frame 34 when the toner container 3Y is attached to the housing 11.

As shown in FIG. 3 and FIG. 5, the support frame 34 includes a support table 51 and a rear end wall 52. The support table 51 is configured to support a bottom surface 64 (see FIG. 4) of the toner container 3Y and has a shape of a plate elongated in the front-rear direction 7. A pair of guide grooves 54 extending in the front-rear direction 7 are formed on an upper surface 57 of the support table 51. The pair of guide grooves 54 are separated from each other by a predetermined interval in the left-right direction 8. The pair of guide grooves 54 are configured to guide the toner container 3Y in the front-rear direction 7, and extend straight along the front-rear direction 7. Specifically, as shown in FIG. 4, the pair of guide grooves 54 are formed like straight lines extending from the front end of the support table 51 toward its rear end. Slide rails 85 (see FIG. 4) provided on the bottom wall 64 of the toner container 3Y are inserted in the pair of guide grooves 54, wherein the slide rails 85 are described below. This allows the toner container 3Y to be supported on the support frame 34 in such a way as to slide horizontally in the front-rear direction 7. When the toner container 3Y is inserted in an insertion direction D1 (see FIG. 3) that is horizontal to the support frame 34, and comes in contact with the rear end wall 52 at the attachment position, the toner container 3Y is attached to the support frame 34.

As shown in FIG. 5, a through hole 55 is formed to pierce through the support table 51 in the up-down direction 6. The through hole 55 communicates with a toner replenishing port (not shown) of the developing device 44. As shown in FIG. 3, in a state where the toner container 3Y is attached at an attachment position (a position where the toner container 3Y is in contact with the rear end wall 52) on the support frame 34, a toner discharge port 67 (see FIG. 4) of the toner container 3Y is located above the through hole 55 of the support table 51.

The rear end wall 52 is provided at a rear end portion of the support table 51. A drive output portion (not shown) such as a rotatably supported gear is provided on the rear end wall 52, and a rotational driving force of a motor (not shown) is transmitted to the drive output portion. When the toner container 3Y is attached to the support frame 34, the drive output portion is coupled with an input gear (not shown) of the toner container 3Y, the input gear being provided to rotate a conveyance member (not shown) provided in the interior of the toner container 3Y. As a driving force is transmitted from the drive output portion to the input gear, the conveyance member is rotated. This allows the toner in the toner container 3Y to be conveyed toward the toner discharge port 67.

As shown in FIG. 5, the incompatibility mechanism 90Y that corresponds to the toner container 3Y is provided on the upper surface 57 of the support table 51. The incompatibility mechanism 90Y permits attachment of the toner container 3Y that has the attachment compatibility, and prohibits attachment of an incompatible toner container 3 that does not have the attachment compatibility. The incompatibility mechanism 90Y includes a compatible arm member 91, three incompatible arm members 92, and four coil springs 95, wherein the compatible arm member 91 is an example of the compatible member of the present disclosure, and the incompatible arm members 92 are an example of the incompatible member of the present disclosure. The compatible arm member 91 and the incompatible arm members 92 are provided at a position that faces a shutter member 70Y of the toner container 3Y during a process in which the toner container 3Y is inserted toward the attachment position of the storage portion 31Y, wherein the shutter member 70Y is described below.

As shown in FIG. 5 and FIG. 6, on the support table 51, a pair of shaft supporting portions 96 are formed to project from the upper surface 57 upward. The shaft supporting portions 96 are disposed on a rear-side portion of the support table 51 so as to be separated from each other by a predetermined interval in the left-right direction 8. One of the shaft supporting portions 96 is provided in the vicinity of a left-side guide groove 54, and the other is provided in the vicinity of a right-side guide groove 54. A cylindrical rocking shaft 97 is attached to the shaft supporting portions 96. Opposite ends of the rocking shaft 97 are respectively fixed to the shaft supporting portions 96.

Figure 7A:
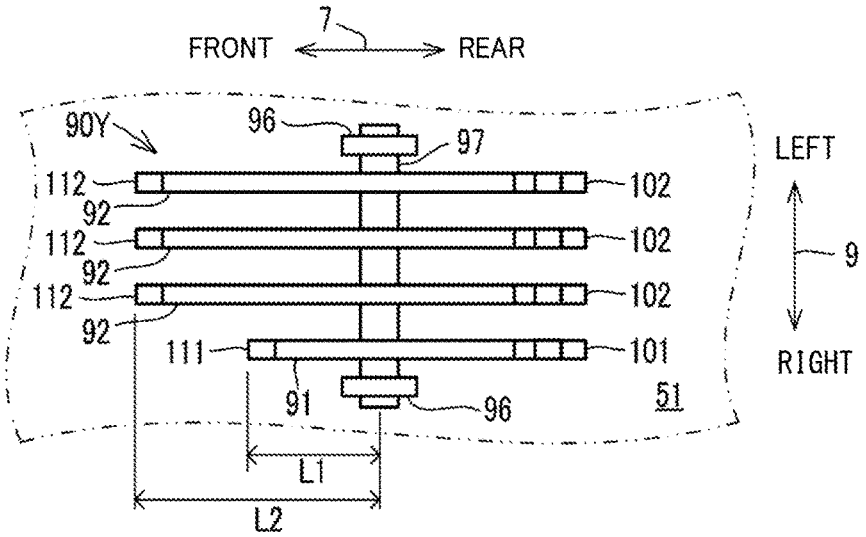
FIG. 7A is a partial enlargement diagram of a shutter member of the toner container for yellow viewed from a bottom side.

As shown in FIG. 6, each of the compatible arm member 91 and the incompatible arm members 92 is formed in the shape of an arm that is elongated in the front-rear direction 7, and is rockably supported by the rocking shaft 97. That is, the rocking shaft 97 is a rocking fulcrum of the compatible arm member 91 and the incompatible arm members 92. The three incompatible arm members 92 are, in a state of being supported by the rocking shaft 97, separated from the compatible arm member 91 along the axial direction of the rocking shaft 97. In the present embodiment, as shown in FIG. 7A, the compatible arm member 91 and the incompatible arm members 92 are, in a state of being supported by the rocking shaft 97, arranged at equal intervals along the axial direction of the rocking shaft 97.

As shown in FIG. 6, a bearing portion 98 is provided in each of the compatible arm member 91 and the incompatible arm members 92. The rocking shaft 97 is inserted through shaft holes formed in the bearing portions 98. With this configuration, the compatible arm member 91 and the incompatible arm members 92 are supported by the rocking shaft 97 in such a manner that they can rock independently of each other.

In the present embodiment, all of the compatible arm member 91 and the incompatible arm members 92 have an equal length between the bearing portion 98 and the rear end portion. In addition, the three incompatible arm members 92 have an equal length L2 (see FIG. 7A) between the bearing portions 98 and the front end portions. On the other hand, the compatible arm member 91 has a length L1 (see FIG. 7A) which is shorter than the length L2, between the bearing portion 98 and the front end portion.

The compatible arm member 91 includes a contact portion 101 (an example of the first contact portion of the present disclosure). The contact portion 101 is, in the compatible arm member 91, located on the rear side of the rocking shaft 97. Specifically, the contact portion 101 is provided in a rear end portion of the compatible arm member 91. In addition, each of the incompatible arm members 92 includes a contact portion 102 (an example of the second contact portion of the present disclosure). The contact portion 102 is, in each of the incompatible arm members 92, located on the rear side of the rocking shaft 97. Specifically, the contact portion 102 is provided in a rear end portion of each of the incompatible arm members 92. The contact portions 101 and 102 are formed in the same shape. Specifically, each of the contact portions 101 and 102 projects upward and has a trapezoidal shape in cross section. More specifically, each of the contact portions 101 and 102 includes a flat peak portion 103, an inclined surface 104 formed on the front side, and an inclined surface 105 formed on the rear side.

In addition, the compatible arm member 91 includes an engaging portion 111 (an example of the first engaging portion of the present disclosure). The engaging portion 111 is, in the compatible arm member 91, located on the front side of the rocking shaft 97. Specifically, the engaging portion 111 is provided in a front end portion of the compatible arm member 91. In addition, each of the incompatible arm members 92 includes an engaging portion 112 (an example of the second engaging portion of the present disclosure). The engaging portion 112 is, in each of the incompatible arm members 92, located on the front side of the rocking shaft 97. Specifically, the engaging portion 112 is provided in a front end portion of each of the incompatible arm members 92. The engaging portions 111 and 112 are formed in the same shape. Specifically, each of the engaging portions 111 and 112 is bent upward in the shape of a hook.

The coil springs 95 are provided respectively in correspondence with the compatible arm member 91 and the incompatible arm members 92. The four coil springs 95 are each a so-called compression spring. The coil spring 95 of the compatible arm member 91 is provided between the contact portion 101 and the upper surface 57 of the support table 51 so as to elastically bias the contact portion 101 upward. It is noted that the coil spring 95 may be replaced with another elastic member as far as it elastically biases the contact portion 101 upward.

In the present embodiment, in a state (uninserted state) where the toner container 3Y is not inserted in the toner container 3Y, the compatible arm member 91 does not receive a force from the toner container 3Y. As a result, in the uninserted state, the compatible arm member 91 receives only the spring force of the coil spring 95 and remains stationary in an attitude where the contact portion 101 is separated upward from the upper surface 57, and the engaging portion 111 of the compatible arm member 91 is in contact with the upper surface 57. In the following description, the attitude of the compatible arm member 91 in which the engaging portion 111 is in contact with the upper surface 57 and the contact portion 101 is separated upward from the upper surface 57, is referred to as a first attitude (corresponding to the first position of the present disclosure) of the compatible arm member 91.

The coil spring 95 of each of the incompatible arm members 92 is provided between the contact portion 102 and the upper surface 57 of the support table 51 so as to elastically bias the contact portion 102 upward. In the present embodiment, in the uninserted state where the toner container 3Y is not inserted in the toner container 3Y, the incompatible arm members 92 do not receive a force from the toner container 3Y. As a result, in the uninserted state, each of the incompatible arm members 92 receives only the spring force of the coil spring 95 and remains stationary in an attitude where the contact portion 102 is separated upward from the upper surface 57, and the engaging portion 112 of the incompatible arm members 92 is in contact with the upper surface 57. In the following description, the attitude of the incompatible arm members 92 where the engaging portions 112 are in contact with the upper surface 57 and the contact portions 102 are separated upward from the upper surface 57, is referred to as a third attitude (corresponding to the third position of the present disclosure) of the incompatible arm members 92.

The toner container 3Y is used to supply toner to the developing device 44. As shown in FIG. 2, the toner container 3Y is attached to the support frame 34 of the storage portion 31Y. The toner container 3Y is attached to the support frame 34 in a detachable manner, and supported so as to slide in the front-rear direction 7 for insertion and removal on the support frame 34.

As shown in FIG. 3 and FIG. 4, the toner container 3Y is elongated in the front-rear direction 7. The toner container 3Y includes a case main body 61 and a lid body 62. The case main body 61 and the lid body 62 are formed from, for example, synthetic resin.

The case main body 61 is configured to store toner, elongated in the front-rear direction 7, and formed approximately in the shape of a rectangular parallelepiped. The case main body 61 stores toner that is used in the developing process performed by the developing device 44. The case main body 61 includes a bottom portion 63 supported by the support table 51 of the support frame 34. The toner discharge port 67 (see FIG. 4) for discharging the toner from inside to outside is formed in the bottom portion 63 of the toner container 3Y. The toner discharge port 67 is formed in a rear-side portion of the bottom portion. In addition, an opening portion (not shown) is formed in an upper surface of the case main body 61. The lid body 62 is formed in a rectangular shape elongated in the front-rear direction 7 in correspondence with the shape of the opening portion in the upper surface of the case main body 61. The lid body 62 is fixed to the upper surface of the case main body 61, thereby closing the opening portion.

A toner filling port (not shown) for filling the case main body 61 with toner is formed in a front surface of the case main body 61. The toner filling port is closed by a plug member 65.

The shutter member 70Y is provided in the bottom portion 63 of the toner container 3Y, wherein the shutter member 70Y is plate-like and used to open and close the toner discharge port 67. The shutter member 70Y is formed from, for example, synthetic resin. The shutter member 70Y is supported by the bottom portion 63 so as to move between a closing position (a position shown in FIG. 4) for closing the toner discharge port 67 and an opening position (a position shown in FIG. 11D) for opening the toner discharge port 67. In the present embodiment, the shutter member 70Y is supported by the bottom portion 63 so as to be slid in the front-rear direction 7 by a slide support mechanism (not shown).

In the present embodiment, a spring member 79 (an example of the biasing member of the present disclosure) is provided on the bottom portion 63 of the toner container 3Y, wherein the spring member 79 is a coil spring, a plate spring or the like. It is noted that the spring member 79 is shown in FIG. 4, but is omitted in FIG. 7A to FIG. 10B. One of opposite ends of the spring member 79 is attached to a spring receiver 78 provided on a rear end of the bottom portion 63, and the other is attached to a rear end of the shutter member 70Y. The spring member 79 is a so-called tension spring and is an elastic member that elastically biases the shutter member 70Y from the opening position toward the closing position. Any configuration may be applied to the spring member 79 as far as it is an elastic member that can elastically bias the shutter member 70Y toward the closing position, and a rubber member may be applied, for example. Even after the toner container 3Y is attached at the attachment position of the storage portion 31Y, and the shutter member 70Y is moved to the opening position, when the toner container 3Y is pulled out from the attachment position, the spring member 79 applies a spring force to the shutter member 70Y so that the shutter member 70Y moves toward the closing position. With this configuration, it is possible to move the shutter member 70Y from the opening position to the closing position when the toner container 3Y is pulled out.

It is noted that although the spring member 79 is provided as an example of a moving mechanism that moves the shutter member 70Y from the opening position to the closing position when the toner container 3Y is pulled out, the moving mechanism is not limited to the spring member 79. For example, it is possible to apply a moving mechanism in which the storage portion 31Y includes an engaging member configured to be engaged with the shutter member 70Y when the toner container 3Y is pulled out, and a biasing force is applied to the shutter member 70Y engaged with the engagement member such that the shutter member 70Y is moved from the opening position to the closing position. The engaging member in this case is an example of the biasing member of the present disclosure.

As shown in FIG. 4, the shutter member 70Y includes a rectangular base portion 71 and a rectangular engagement piece 72, wherein the base portion 71 covers the toner discharge port 67, and the engagement piece 72 projects from a front-right end portion of the base portion 71 toward the front. The base portion 71 of the shutter member 70Y is integrally formed with a projection rib 74Y (an example of the compatible key of the present disclosure) that projects downward. The projection rib 74Y realizes the attachment compatibility that allows the toner container 3Y to be attached only to the storage portion 31Y that corresponds to the toner container 3Y, and the projection rib 74Y is formed at a position (compatible position) that is unique to the toner container 3Y for yellow. In other words, the projection rib 74Y is provided at a position that corresponds to a type (for example, toner color) of the toner container 3Y. In the present embodiment, the projection rib 74Y is provided at a right-end portion of the base portion 71. At this position, the projection rib 74Y comes in contact with the contact portion 101 of the compatible arm member 91 when the toner container 3Y is inserted in the storage portion 31Y. The projection rib 74Y is a rib-like member that extends in the front-rear direction 7, and is trapezoidal in a cross section. Specifically, the projection rib 74Y includes a flat peak portion 741, an inclined surface 742 formed in a front end portion, and an inclined surface 743 formed in a rear end portion.

Figure 7B:
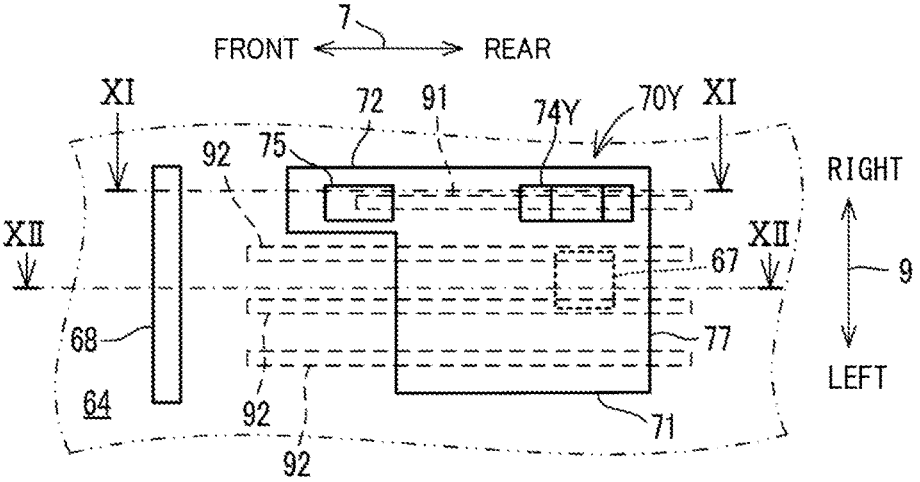
FIG. 7B is a partial enlargement diagram of an incompatibility mechanism for yellow viewed from above.

In addition, the shutter member 70Y has a rectangular engagement hole 75 (an example of the engaged portion of the present disclosure) that pierces through the shutter member 70Y. As shown in FIG. 7B, the engagement hole 75 is provided at a position in the shutter member 70Y that is separated from the projection rib 74Y toward the front, namely, the engagement hole 75 is separated from the projection rib 74Y in a direction opposite to the insertion direction D1 (see FIG. 3) in which the toner container 3Y is inserted. In the present embodiment, the engagement hole 75 is formed at the center of the engagement piece 72. It is noted that in FIG. 7B, the compatible arm member 91 and the incompatible arm members 92 are indicated by a dotted line to help understand the positional relationship between the shutter member 70Y and the compatible arm member 91 and the incompatible arm members 92 in the left-right direction 8.

In addition, as shown in FIG. 4, a stopper member 68 (an example of the projection portion of the present disclosure) that projects downward from the bottom portion 63 of the toner container 3Y, is formed on the bottom portion 63. The stopper member 68 is formed integrally with the bottom portion 63. The stopper member 68 is provided on the front side of the shutter member 70Y. The stopper member 68 is a rib-like member extending in the left-right direction 8. The stopper member 68 has a role of, when a toner container 3 that does not have attachment compatibility with the storage portion 31Y for yellow is inserted therein, preventing the toner container 3 from being inserted to the attachment position. In addition, the stopper member 68 has a role of, when the toner container 3Y that has attachment compatibility with the storage portion 31Y for yellow is inserted therein, restricting the movement of the shutter member 70Y that has moved to the opening position and prohibiting the shutter member 70Y from further moving from there.

Next, the configuration of the toner container 3C and the configuration of the storage portion 31C for storing the toner container 3C are described. It is noted that the toner container 3C and the storage portion 31C have the same configurations as the toner container 3Y and the storage portion 31Y except for partial configuration of the shutter member 70C and the incompatibility mechanism 90C. As a result, in the following description, components that are the same as those of the toner container 3Y and the storage portion 31Y are assigned the same reference signs, and description thereof is omitted.

Figure 8A:
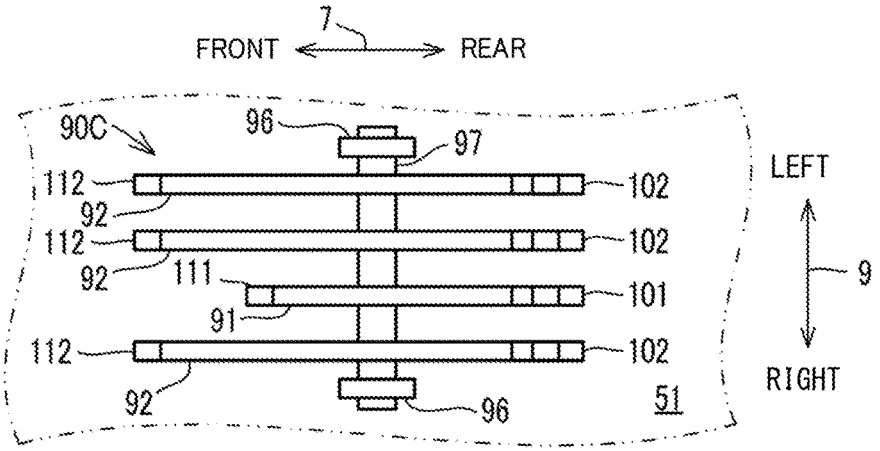
FIG. 8A is a partial enlargement diagram of a shutter member of a toner container for cyan viewed from a bottom side.

As shown in FIG. 8A, the incompatibility mechanism 90C that corresponds to the toner container 3C is provided on the support table 51 of the support frame 34 of the storage portion 31C. The incompatibility mechanism 90C permits an attachment of the toner container 3C that has the attachment compatibility, and prohibits an attachment of an incompatible toner container 3 that does not have the attachment compatibility. The incompatibility mechanism 90C has the same configuration as the above-described incompatibility mechanism 90Y and includes a compatible arm member 91 and three incompatible arm members 92. However, in the incompatibility mechanism 90C, the compatible arm member 91 is located at the second position from the right among the compatible arm member 91 and the incompatible arm members 92 aligned in the left-right direction 8. In this point, the incompatibility mechanism 90C is different from the above-described incompatibility mechanism 90Y.

Figure 8B:
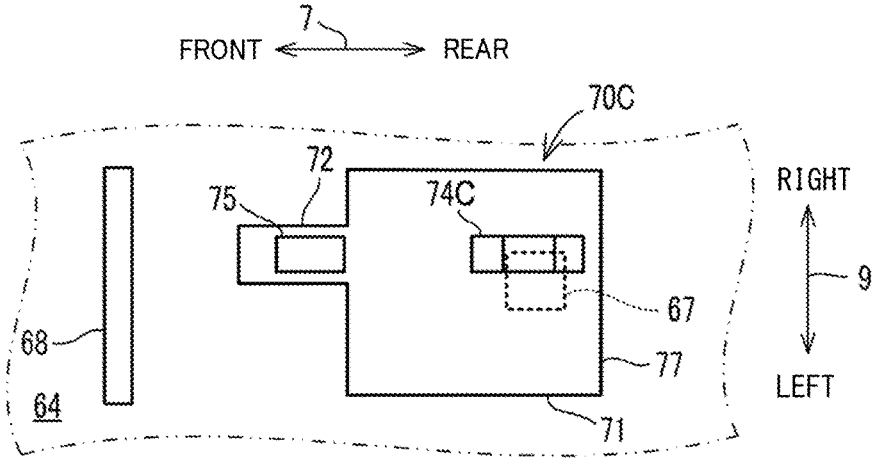
FIG. 8B is a partial enlargement diagram of an incompatibility mechanism for cyan viewed from above.

In addition, as shown in FIG. 8B, the toner container 3C includes a plate-like shutter member 70C for opening and closing the toner discharge port 67. The shutter member 70C includes the base portion 71 and the engagement piece 72. The shutter member 70C is also provided with a projection rib 74C that has the same shape as the projection rib 74Y. The projection rib 74C is provided at a different position from the projection rib 74Y, and the position of the projection rib 74C is shifted toward the left from the projection rib 74Y. The projection rib 74C is provided at a position (compatible position) that corresponds to the toner container 3C, and at this position, the projection rib 74C comes in contact with the contact portion 101 of the compatible arm member 91 when the toner container 3C is inserted in the storage portion 31C. It is noted that in this case, in the shutter member 70C, the engagement piece 72 is formed to be separated from the projection rib 74C toward the front.

Next, the configuration of the toner container 3M and the configuration of the storage portion 31M for storing the toner container 3M are described. It is noted that the toner container 3M and the storage portion 31M have the same configurations as the toner container 3Y and the storage portion 31Y except for partial configuration of the shutter member 70M and the incompatibility mechanism 90M. As a result, in the following description, components that are the same as those of the toner container 3Y and the storage portion 31Y are assigned the same reference signs, and description thereof is omitted.

Figure 9A:
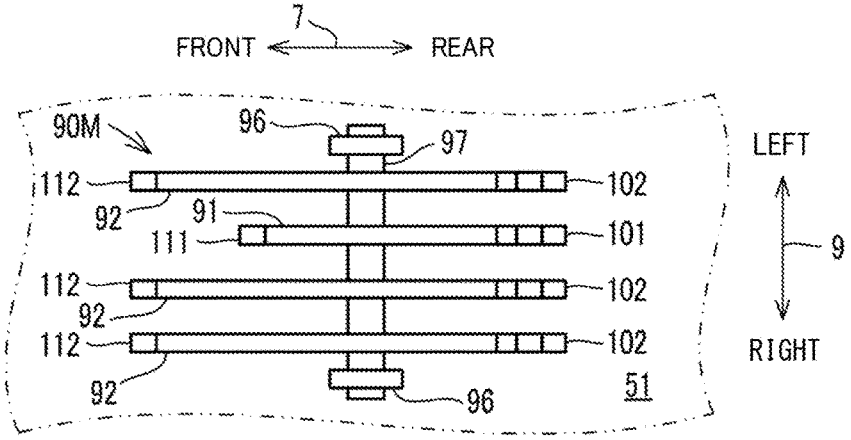
FIG. 9A is a partial enlargement diagram of a shutter member of a toner container for magenta viewed from a bottom side.

As shown in FIG. 9A, an incompatibility mechanism 90M that corresponds to the toner container 3M is provided on the support table 51 of the support frame 34 of the storage portion 31M. The incompatibility mechanism 90M permits an attachment of a toner container 3M that has the attachment compatibility, and prohibits an attachment of an incompatible toner container 3 that does not have the attachment compatibility. The incompatibility mechanism 90M has the same configuration as the above-described incompatibility mechanism 90Y and includes a compatible arm member 91 and three incompatible arm members 92. However, in the incompatibility mechanism 90M, the compatible arm member 91 is located at the third position from the right among the compatible arm member 91 and the incompatible arm members 92 aligned in the left-right direction 8. In this point, the incompatibility mechanism 90M is different from the above-described incompatibility mechanism 90Y.

Figure 9B:
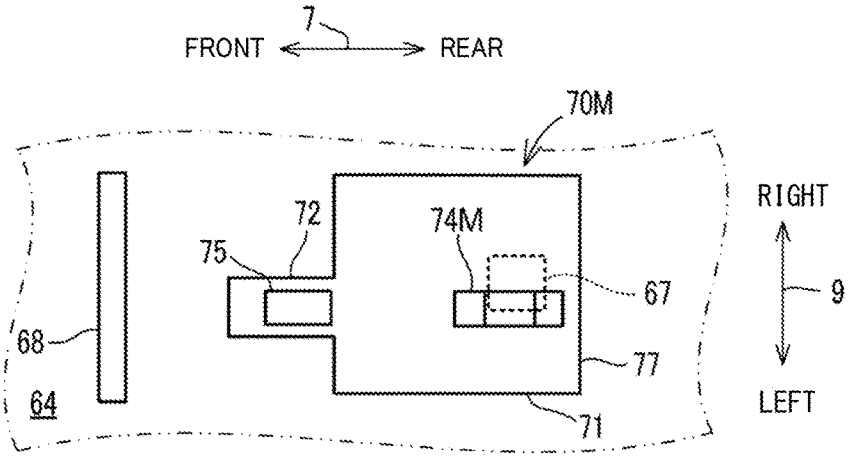
FIG. 9B is a partial enlargement diagram of an incompatibility mechanism for magenta viewed from above.

As shown in FIG. 9B, the toner container 3M includes a plate-like shutter member 70M for opening and closing the toner discharge port 67. The shutter member 70M includes the base portion 71 and the engagement piece 72. The shutter member 70M is also provided with a projection rib 74M that has the same shape as the projection rib 74Y. The projection rib 74M is provided at a different position from the projection rib 74Y, 74C and the position of the projection rib 74M is shifted toward the left from the projection rib 74C. The projection rib 74M is provided at a position (compatible position) that corresponds to the toner container 3M, and at this position, the projection rib 74M comes in contact with the contact portion 101 of the compatible arm member 91 when the toner container 3M is inserted in the storage portion 31M. It is noted that in this case, in the shutter member 70M, the engagement piece 72 is formed to be separated from the projection rib 74M toward the front.

Next, the configuration of the toner container 3K and the configuration of the storage portion 31K for storing the toner container 3K are described. It is noted that the toner container 3K and the storage portion 31K have the same configurations as the toner container 3Y and the storage portion 31Y except for partial configuration of the shutter member 70K and the incompatibility mechanism 90K. As a result, in the following description, components that are the same as those of the toner container 3Y and the storage portion 31Y are assigned the same reference signs, and description thereof is omitted.

Figure 10A:
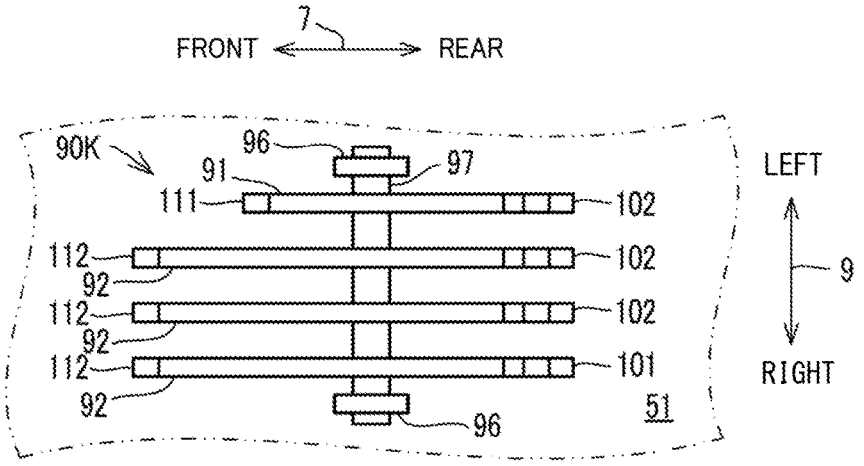
FIG. 10A is a partial enlargement diagram of a shutter member of a toner container for black viewed from a bottom side.

As shown in FIG. 10A, an incompatibility mechanism 90K that corresponds to the toner container 3K is provided on the support table 51 of the support frame 34 of the storage portion 31K. The incompatibility mechanism 90K permits an attachment of a toner container 3K that has the attachment compatibility, and prohibits an attachment of an incompatible toner container 3 that does not have the attachment compatibility. The incompatibility mechanism 90K has the same configuration as the above-described incompatibility mechanism 90Y and includes a compatible arm member 91 and three incompatible arm members 92. However, in the incompatibility mechanism 90K, the compatible arm member 91 is located at the fourth position from the right (the leftmost position) among the compatible arm member 91 and the incompatible arm members 92 aligned in the left-right direction 8. In this point, the incompatibility mechanism 90K is different from the above-described incompatibility mechanism 90Y.

Figure 10B:
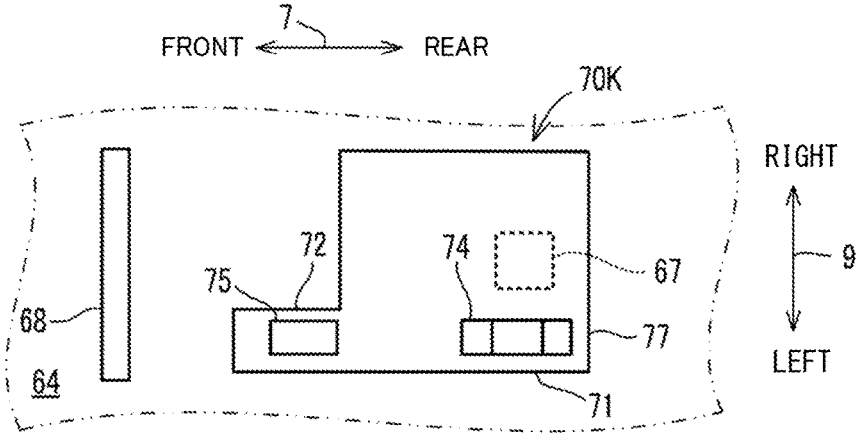
FIG. 10B is a partial enlargement diagram of an incompatibility mechanism for black viewed from above.

As shown in FIG. 10B, the toner container 3K includes a plate-like shutter member 70K for opening and closing the toner discharge port 67. The shutter member 70K includes the base portion 71 and the engagement piece 72. The shutter member 70K is also provided with a projection rib 74K that has the same shape as the projection rib 74Y. The projection rib 74K is provided at a different position from the projection rib 74Y, 74C, 74M and the position of the projection rib 74K is shifted toward the left from the projection rib 74M. The projection rib 74K is provided at a position (compatible position) that corresponds to the toner container 3K, and at this position, the projection rib 74K comes in contact with the contact portion 101 of the compatible arm member 91 when the toner container 3K is inserted in the storage portion 31K. It is noted that in this case, in the shutter member 70K, the engagement piece 72 is formed to be separated from the projection rib 74K toward the front.

The following describes how the incompatibility mechanism 90Y operates when the toner container 3Y for yellow that has attachment compatibility with the storage portion 31Y, is inserted in the storage portion 31Y, with reference to FIG. 11A to FIG. 12D. Here, FIG. 11A to FIG. 11D are cross-sectional diagrams taken along a cutting line XI-XI shown in FIG. 7B and show operations of the compatible arm member 91. FIG. 12A to FIG. 12D are cross-sectional diagrams taken along a cutting line XII-XII shown in FIG. 7B and show operations of the incompatible arm members 92.

When the toner container 3Y for yellow is inserted from a front-side opening of the storage portion 31Y toward the depth of the storage portion 31Y, the shutter member 70Y reaches above the incompatibility mechanism 90Y. At this time, the compatible arm member 91 is in the first attitude, and the engaging portion 111 is separated downward from an insertion path P1 of the projection rib 74Y. As a result, the projection rib 74Y of the shutter member 70Y moves toward the rear by passing over the engaging portion 111 without contacting thereof (see FIG. 11A). In addition, the incompatible arm members 92 are in the third attitude, and the engaging portions 112 are separated downward from the shutter member 70Y. As a result, the shutter member 70Y moves toward the rear by passing over the engaging portions 112 without contacting thereof (see FIG. 12A).

Figure 11A:
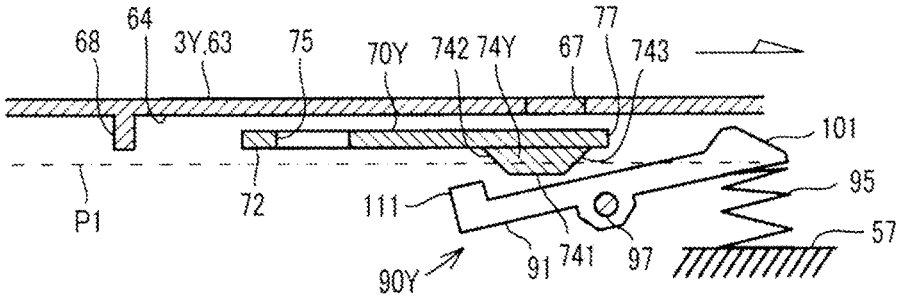
FIG. 11A to FIG. 11D are diagrams showing an operation of the incompatibility mechanism when the toner container for yellow is inserted in the storage portion.
Figure 12A:
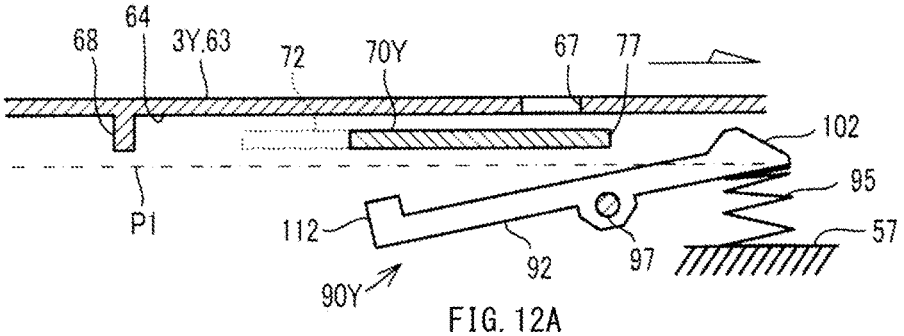
FIG. 12A to FIG. 12D are diagrams showing an operation of the incompatibility mechanism when the toner container for yellow is inserted in the storage portion.

In the present embodiment, as shown in FIG. 11A, when the compatible arm member 91 is in the first attitude, the engaging portion 111 is separated downward from the insertion path P1, and the contact portion 101 is disposed so as to intersect the insertion path P1. In addition, as shown in FIG. 12A, when the incompatible arm members 92 are in the third attitude, the engaging portions 112 are separated downward from the insertion path P1, and the contact portions 102 intersect the insertion path P1 when viewed from a side.

Figure 11B:
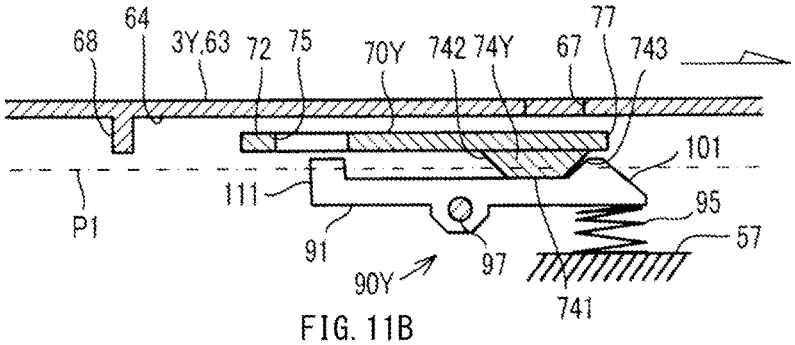

When the toner container 3Y for yellow is further inserted to the depth of the storage portion 31Y, the projection rib 74Y of the shutter member 70Y comes in contact with the compatible arm member 91, and presses the compatible arm member 91 downward. This allows the contact portion 101 to move downward, and the compatible arm member 91 to rock clockwise in FIG. 11B (see FIG. 11B). At this time, as shown in FIG. 11B, the compatible arm member 91 extends approximately in the horizontal direction.

Figure 11C:
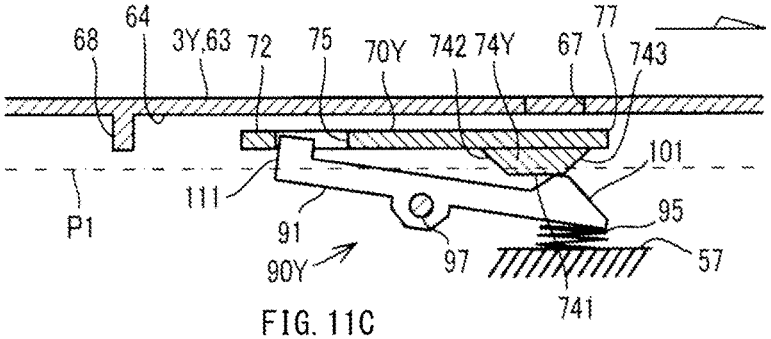
Figure 11D:
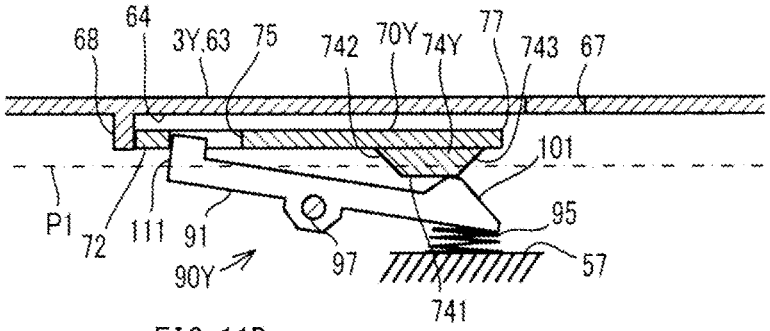

When the toner container 3Y for yellow is further inserted in the storage portion 31Y, the projection rib 74Y comes in contact with the inclined surface 104 and then the peak portion 103 of the contact portion 101 and presses down the contact portion 101 (see FIG. 11C). That is, during the process in which the toner container 3Y is inserted in the storage portion 31Y, the projection rib 74Y of the shutter member 70Y comes in contact with the contact portion 101 and allows the compatible arm member 91 to rock clockwise. This changes the attitude of the compatible arm member 91 from the first attitude to the second attitude (an example of the second position of the present disclosure), wherein the second attitude is desribed below.

Here, the second attitude is the attitude shown in FIG. 11C, and when the compatible arm member 91 is in the second attitude, the engaging portion 111 is inserted in the engagement hole 75 of the engagement piece 72, and the compatible arm member 91 is engaged with the shutter member 70Y in the front-rear direction 7, and the contact portion 101 is separated from the insertion path P1 downward. Since the contact portion 101 is separated downward, the shutter member 70Y is not interfered by the compatible arm member 91, and the inserted toner container 3Y is allowed to reach the attachment position.

When the toner container 3Y is further inserted while the compatible arm member 91 is in the second attitude, the shutter member 70Y is relatively moved toward the front by the engaging portion 111, and the shutter member 70Y slides from the closing position (see FIG. 11C) for closing the toner discharge port 67 to the opening position (see FIG. 11D) for opening the toner discharge port 67. This allows the toner discharge port 67 to be opened, and the toner is replenished to the developing device 44. Subsequently, when the engagement piece 72 of the shutter member 70Y abuts on the stopper member 68, the stopper member 68 stops the shutter member 70Y at the opening position and restricts it from further moving. At this time, the toner container 3Y is restricted from further moving toward the rear by the engaging portion 111 via the engagement hole 75, and is disposed at the attachment position.

Figure 12B:
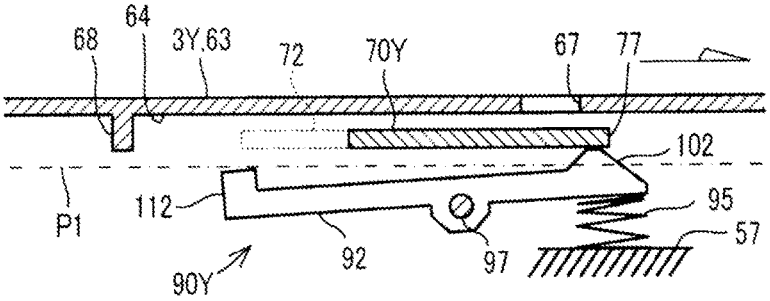
Figure 12C:
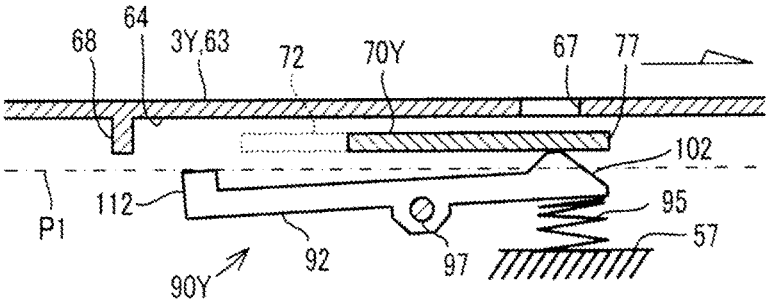
Figure 12D:
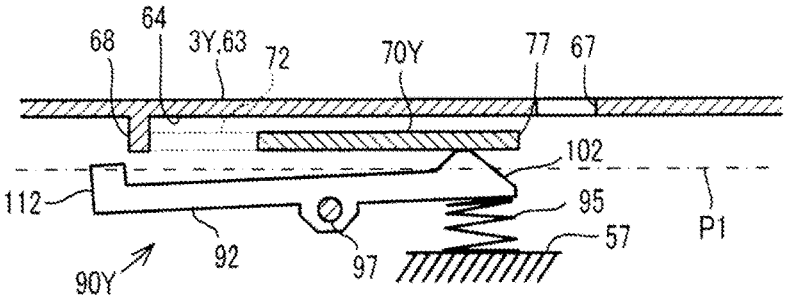

On the other hand, as shown in FIG. 12B, during the process in which the toner container 3Y is inserted in the storage portion 31Y, a rear end portion 77 of the shutter member 70Y comes in contact with the contact portions 102 of the incompatible arm members 92 and presses them downward. This allows the contact portions 102 to move downward, allowing the incompatible arm members 92 to rock clockwise in FIG. 12B. In this way, since the contact portions 102 move downward, the shutter member 70Y is not interfered by the incompatible arm members 92, and the inserted toner container 3Y is allowed to reach the attachment position.

However, since the projection rib 74Y does not come in contact with any of the contact portions 102, the rocking amount of each of the incompatible arm members 92 (the pressed-down amount of each of the contact portions 102) is smaller than the rocking amount of the compatible arm member 91 (the pressed-down amount of the contact portion 101). As a result, the incompatible arm members 92 do not rock up to a position where the engaging portions 112 come in contact with the shutter member 70Y. Nor do the incompatible arm members 92 rock up to a position where the engaging portions 112 interfere with the stopper member 68 (see FIG. 12C). In this case, when the toner container 3Y is further inserted, the stopper member 68 moves toward the rear by passing over the engaging portions 112, and the toner container 3Y is inserted up to the attachment position without being interrupted by the engaging portion 112 (see FIG. 12D).

Figure 13:
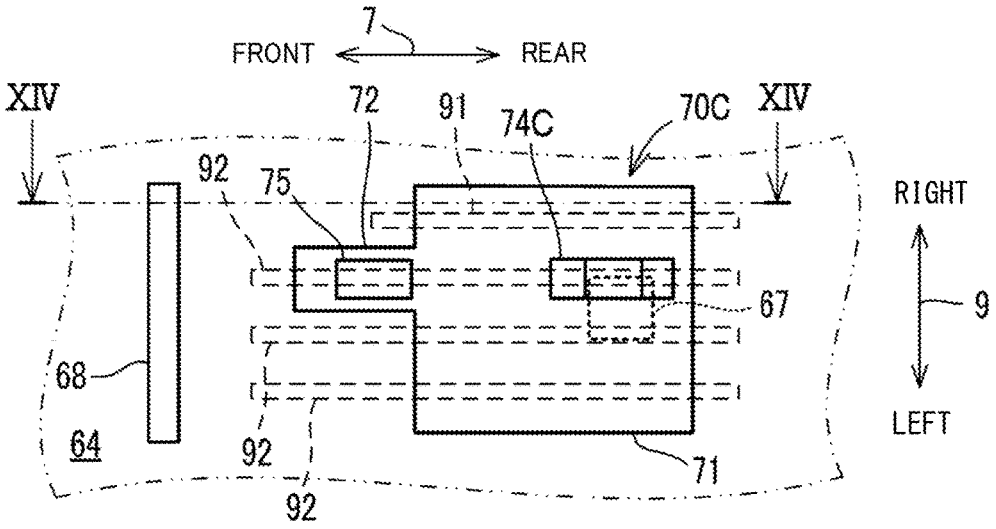
FIG. 13 is a diagram showing a positional relationship between: a shutter member of the toner container for cyan; and a compatible arm member and incompatible arm members of the incompatibility mechanism for yellow.

In the following, with reference to FIG. 13 to FIG. 14D, a description is given of an operation of the incompatibility mechanism 90Y when the toner container 3C is erroneously inserted in the storage portion 31Y for yellow with which it does not have attachment compatibility. Here, FIG. 13 shows a positional relationship between: the shutter member 70C of the toner container 3C; and the compatible arm member 91 and the incompatible arm members 92 of the incompatibility mechanism 90Y. In FIG. 13, the compatible arm member 91 and the incompatible arm members 92 are represented by a dotted line. In addition, FIG. 14A to FIG. 14D are cross-sectional diagrams taken along a cutting line XIV-XIV shown in FIG. 13, and show operation of the compatible arm member 91.

The toner container 3C for cyan does not have attachment compatibility with the storage portion 31Y for yellow. That is, the toner container 3C is incompatible with the storage portion 31Y. As a result, even when the incompatible toner container 3C is inserted from the front-side opening of the storage portion 31Y toward its depth, the projection rib 74C of the shutter member 70C does not pass above the compatible arm member 91 of the incompatibility mechanism 90Y, but moves toward the rear above one of the incompatible arm members 92 (see FIG. 13).

Figure 14A:
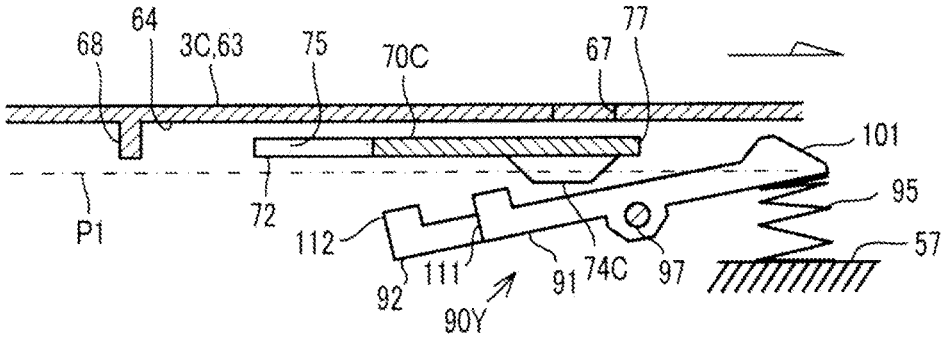
FIG. 14A to FIG. 14D are cross-sectional diagrams taken along a cutting line XIV-XIV shown in FIG. 13, and show an operation of the compatible arm member.

As shown in FIG. 14A, during the process in which the toner container 3C is inserted in the storage portion 31Y, the shutter member 70C reaches above the incompatibility mechanism 90Y. At this time, the compatible arm member 91 is in the first attitude and the incompatible arm members 92 is in the third attitude. Thus, both the engaging portions 111 and 112 are separated downward from the shutter member 70C. As a result, the shutter member 70C pass above the engaging portions 111 and 112 toward the rear without contacting them (see FIG. 14A).

Figure 14B:
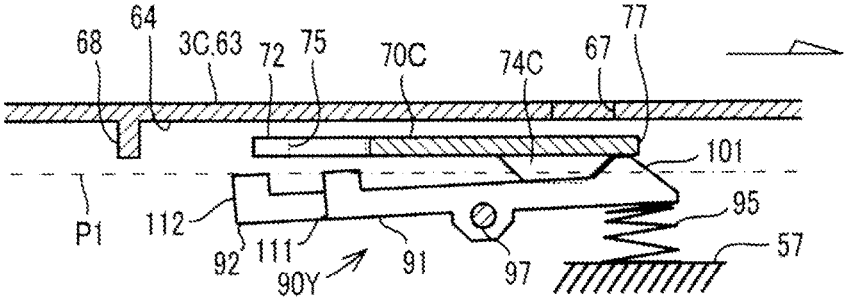

As shown in FIG. 14B, during the process in which the toner container 3C is inserted in the storage portion 31Y, the rear end portion 77 of the shutter member 70C comes in contact with the contact portion 101 of the compatible arm member 91 and presses it downward. This allows the contact portion 101 to move downward slightly, and the compatible arm member 91 rocks clockwise in FIG. 14B (see FIG. 14B). At this time, the projection rib 74C does not come in contact with the contact portion 101, but comes in contact with one of the contact portions 102 of the incompatible arm members 92. Since the projection rib 74C does not come in contact with the contact portion 101, the rocking amount of the compatible arm member 91 (the pressed-down amount of the contact portion 101) is smaller than a case where the projection rib 74C comes in contact with the contact portion 101. As a result, the compatible arm member 91 does not rock to a point where the compatible arm member 91 is in the second attitude, but maintains an attitude in which the engaging portion 111 is not inserted in the engagement hole 75 (see FIG. 14C). In this case, even when the toner container 3C is further inserted, a biasing force toward the opening position is not applied to the shutter member 70C. As a result, the shutter member 70C maintains the closing position, and the toner discharge port 67 is not opened.

Figure 14C:
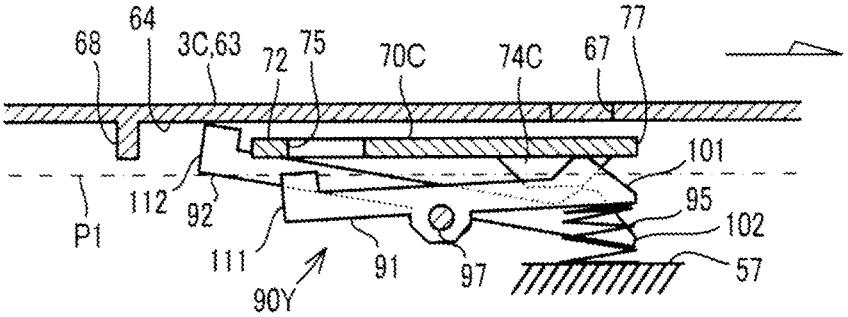
Figure 14D:
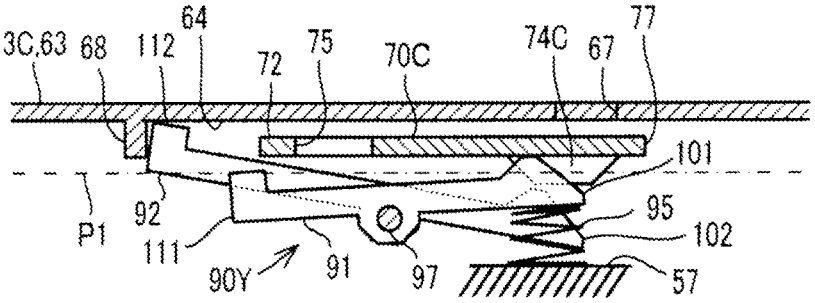

On the other hand, during the process in which the toner container 3C is inserted in the storage portion 31Y, when the projection rib 74C comes in contact with the contact portion 102 of the one of the incompatible arm members 92, the projection rib 74C reaches the peak portion 103 of the contact portion 102 via the inclined surface 104, and presses the contact portion 102 downward (see FIG. 14C). That is, during the process in which the toner container 3C is inserted in the storage portion 31Y, the projection rib 74C of the shutter member 70C comes in contact with the contact portion 102 of one of the incompatible arm members 92, and causes the incompatible arm member 92 to rock clockwise. This allows the incompatible arm member 92 to change from the third attitude to a fourth attitude (corresponding to the fourth position of the present disclosure) that is described below.

Here, the fourth attitude is the attitude of the incompatible arm member 92 shown in FIG. 14C, and the attitude is made as the incompatible arm member 92 is rocked by the projection rib 74C during the process in which the incompatible toner container 3C is inserted in the storage portion 31Y, and when the incompatible arm member 92 is in the fourth attitude, the engaging portion 112 is engaged with the stopper member 68, and the contact portion 102 is separated downward from the insertion path P1. At this time, since the contact portion 102 is separated downward, the toner container 3C is not interfered by the contact portion 102, but, as shown in FIG. 14D, the engaging portion 112 is engaged with the stopper member 68. Thus the toner container 3C is prohibited from being inserted up to the attachment position.

It is noted that there may be a case where a toner container 3C is inserted in the storage portion 31Y in a state where the projection rib 74C of the shutter member 70C is broken. In that case, the pressed-down amount of the contact portion 102 pressed down by the projection rib 74C is small, and the incompatible arm member 92 does not pivot from the third attitude (see FIG. 14A) to the fourth attitude (see FIG. 14C). In that case, the toner container 3C is inserted up to the attachment position while the shutter member 70C is maintained at the closing position.

Here, assume that a toner container is inserted in any of the storage portions 31, wherein the toner container includes a shutter member on which is formed a projection portion that is configured to press down all of the contact portion 101 of the compatible arm member 91 and the contact portions 102 of the incompatible arm members 92 during the process in which the toner container 3C is inserted in the storage portion 31Y. Then the compatible arm member 91 rocks from the first attitude to the second attitude so as to move the shutter member from the closing position to the opening position. However, since the incompatible arm members 92 also rock from the third attitude to the fourth attitude, the engaging portions 112 of the incompatible arm members 92 are engaged with the stopper member 68. As a result, insertion of the toner container up to the attachment position is prohibited before the shutter member reaches the opening position, thus the toner discharge port 67 is not opened.

It is noted here that the above-described embodiment explains, as one example, how the incompatibility mechanism 90Y operates when the toner container 3C for cyan is erroneously inserted in the storage portion 31Y for yellow with which the toner container 3C does not have compatibility. However, when a toner container for one color is inserted in a storage portion for another color, an incompatibility mechanism provided in the storage portion operates in the same manner.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner case including a shutter member configured to move between an opening position and a closing position, wherein when the shutter member is at the opening position, a toner discharge port formed in a bottom portion of the toner case is opened, and when the shutter member is at the closing position, the toner discharge port is closed; and a case attachment portion configured to support the toner case inserted therein toward a predetermined attachment position such that the toner case is attached at the attachment position in a detachable manner, wherein the shutter member includes:

a compatible key projecting downward from the shutter member and provided at a compatible position that corresponds to a type of the toner case; and an engaged portion provided at a position separated from the compatible key in a direction opposite to an insertion direction in which the toner case is inserted in the case attachment portion, the case attachment portion includes:

a compatible member rockably supported at a position that faces the shutter member during a process in which the toner case is inserted in the case attachment portion, the compatible member including a first contact portion and a first engaging portion, the first contact portion being located on a forward side of a rocking fulcrum in the insertion direction, the first engaging portion being located on a backward side of the rocking fulcrum in the insertion direction, in a state where the toner case is not inserted in the case attachment portion, the compatible member is disposed at a first position where the first engaging portion is separated from an insertion path of the compatible key, and the first contact portion intersects the insertion path, and during the process in which the toner case is inserted in the case attachment portion, the compatible member is disposed at a second position where the compatible key comes in contact with the first contact portion and causes the compatible member to rock so that the first contact portion is separated from the insertion path and the first engaging portion is engaged with the engaged portion, and the shutter member moves from the closing position to the opening position.

2. The image forming apparatus according to claim 1, wherein the toner case includes:

a projection portion projecting downward from the bottom portion and provided on the backward side of the shutter member in the insertion direction, the case attachment portion includes:

an incompatible member rockably supported at a position separated from the compatible member along a rocking axis direction, the incompatible member including a second contact portion and a second engaging portion, the second contact portion being located on the forward side of the rocking fulcrum in the insertion direction, the second engaging portion being located on the backward side of the rocking fulcrum in the insertion direction, wherein in a case where an incompatible toner case having a compatible key at a position corresponding to the incompatible member, is attached, in a state where the incompatible toner case is not inserted, the compatible member is disposed at a third position where the second engaging portion is separated from the insertion path of the compatible key, and the second contact portion intersects the insertion path, and during a process in which the incompatible toner case is inserted in the case attachment portion, the compatible member is disposed at a fourth position where the compatible key comes in contact with the second contact portion and causes the compatible member to rock so that the second engaging portion is engaged with the projection portion and the second contact portion is separated from the insertion path.

3. The image forming apparatus according to claim 2, wherein when the shutter member moves from the closing position to the opening position, the projection portion comes in contact with the shutter member and restricts the shutter member from moving further.

4. The image forming apparatus according to claim 1, further comprising:

a biasing member configured to, when the toner case is pulled out from the attachment position of the case attachment portion, bias the shutter member toward the closing position.

5. The image forming apparatus according to claim 4, wherein the biasing member is an elastic member provided in the toner case and configured to elastically bias the shutter member from the opening position toward the closing position.

6. A toner case comprising a shutter member configured to move between an opening position and a closing position, wherein when the shutter member is at the opening position, a toner discharge port formed in a bottom portion of the toner case is opened, and when the shutter member is at the closing position, the toner discharge port is closed, the toner case being attachable at a predetermined attachment position in a case attachment portion, wherein the shutter member includes:

a compatible key projecting downward from the shutter member and provided at a compatible position that corresponds to a type of the toner case; and an engaged portion provided at a position separated from the compatible key in a direction opposite to an insertion direction in which the toner case is inserted in the case attachment portion, and during a process in which the toner case is inserted toward the attachment position, a compatible member provided in the case attachment portion is separated from an insertion path of the compatible key, and a part of the compatible member is engaged with the engaged portion in response to separation of the compatible member from the insertion path such that the shutter member moves from the closing position to the opening position.

* * * * *